US007169998B2

(12) United States Patent
Kondo et al.

(10) Patent No.: US 7,169,998 B2
(45) Date of Patent: Jan. 30, 2007

(54) SOUND GENERATION DEVICE AND SOUND GENERATION PROGRAM

(75) Inventors: Koji Kondo, Kyoto (JP); Yasushi Ida, Kyoto (JP)

(73) Assignee: Nintendo Co., Ltd., Kyoto (JP)

( * ) Notice: Subject to any disclaimer, the term of this patent is extended or adjusted under 35 U.S.C. 154(b) by 409 days.

(21) Appl. No.: 10/623,491

(22) Filed: Jul. 22, 2003

(65) Prior Publication Data

US 2004/0040434 A1 Mar. 4, 2004

(30) Foreign Application Priority Data

Aug. 28, 2002 (JP) ..... 2002-249606

(51) Int. Cl.
*G10H 7/00* (2006.01)

(52) U.S. Cl. ..... 84/615; 84/653

(58) Field of Classification Search ..... 84/615–619, 84/653–658, 678–690, 604; 463/30, 35
See application file for complete search history.

(56) References Cited

U.S. PATENT DOCUMENTS

| | | | | |
|---|---|---|---|---|
| 4,341,140 | A | 7/1982 | Ishida | |
| 4,364,299 | A * | 12/1982 | Nakada et al. | 84/478 |
| 5,393,926 | A | 2/1995 | Johnson | |
| 5,422,956 | A * | 6/1995 | Wheaton | 381/122 |
| 5,491,297 | A | 2/1996 | Johnson et al. | |
| 5,728,960 | A | 3/1998 | Sitrick | |
| 5,739,457 | A | 4/1998 | Devecka | |
| 5,857,171 | A * | 1/1999 | Kageyama et al. | 704/268 |
| 6,018,121 | A | 1/2000 | Devecka | |
| 6,084,168 | A | 7/2000 | Sitrick | |
| 6,268,557 | B1 | 7/2001 | Devecka | |
| 6,297,438 | B1 * | 10/2001 | Por Paul | 84/600 |
| 6,369,313 | B2 | 4/2002 | Devecka | |
| 6,375,572 | B1 | 4/2002 | Masuyama et al. | |
| 6,464,482 | B1 | 10/2002 | Van Der Sluis et al. | |
| 6,464,585 | B1 * | 10/2002 | Miyamoto et al. | 463/35 |
| 6,641,482 | B2 | 11/2003 | Masuyama et al. | |
| 6,835,887 | B2 | 12/2004 | Devecka | |
| 6,908,386 | B2 | 6/2005 | Suzuki et al. | |
| 6,908,388 | B2 | 6/2005 | Shimizu et al. | |
| 2003/0041721 | A1 * | 3/2003 | Nishitani et al. | 84/609 |
| 2003/0196542 | A1 * | 10/2003 | Harrison | 84/737 |

FOREIGN PATENT DOCUMENTS

| | | |
|---|---|---|
| JP | 10-049192 | 2/1998 |
| JP | 11-249658 | 9/1999 |
| JP | 2001-170358 | 6/2001 |

* cited by examiner

*Primary Examiner*—Marlon T. Fletcher
*Assistant Examiner*—David S. Warren
(74) *Attorney, Agent, or Firm*—Nixon & Vanderhye, PP.C.

(57) ABSTRACT

A sound generation device is composed of a main unit and a game cartridge storing a sound generation program. The game cartridge includes an XY-axes acceleration sensor for detecting a tilt in two respective directions of a game device housing. When a button of the main unit is pressed, a CPU of in the main unit reads waveform data corresponding to one syllable in lyrics from human voice sound waveform data stored in a program ROM, changes a frequency and an amplitude of the waveform data in accordance with the obtained amounts of tilts in two directions, and outputs the processed waveform data from a loudspeaker as a sound. Thus, it is possible to provide a sound generation device capable of outputting a sound by changing its pitch and volume.

21 Claims, 8 Drawing Sheets

SOUND GENERATION DEVICE AND SOUND GENERATION PROGRAM

BACKGROUND

1. Field

The present technology described herein relates to sound generation devices and sound generation programs. More particularly, the present technology described herein relates to a sound generation device capable of changing a pitch, etc., of a sound with a simple operation and outputting the sound, and a sound generation program used in the above-described sound generation device.

2. Description of Background Art

Conventionally, there are many well-known methods to perform music using an electronic device. For example, a certain type of electronic musical instrument outputs an instrument sound stored electronically in advance from a loudspeaker concurrently with a performer's touch on a keyboard. Also, as an alternative example, an electronic musical instrument that outputs, for example, a drum sound when the performer beats a drum pad, etc., is known.

Furthermore, an electronic musical instrument called a sampler allowing the performer to electronically store his/her favorite instrument sound is also well known. The performer causes the sampler to store the instrument sound in advance and changes a pitch of the stored instrument sound, thereby freely performing his/her favorite tune. Especially, it is possible to cause the sampler to store a human voice sound in advance and output the stored human voice sound in response to a keyboard operation. As such, the use of the sampler also allows the performer to perform music as if someone were singing a song, by operating the keyboard.

However, the above-described conventional techniques have the following problems. First, the performer is required to have knowledge about keyboard instruments and skills to play a keyboard. Thus, a performer having no knowledge and skills as described above cannot fully enjoy playing the keyboard instrument. Also, the electronic musical instrument outputting a drum sound in response to a beat on the drum pad, etc., cannot change a pitch of the sound on a standalone basis. As a result, unless a plurality of drum pads are provided, it is difficult for the performer to perform music melodiously with the above-described electronic musical instrument.

Furthermore, the performer is also required to have specialized knowledge in the case of causing the sampler to store the human voice sound and sing a song. Thus, the sampler is not suitable for an ordinary user who desires to enjoy music by causing the electronic musical instrument to sing a song.

SUMMARY OF EXEMPLARY EMBODIMENTS

Therefore, an aspect of exemplary embodiments of the present technology described herein is to provide a sound generation device allowing even a beginner to enjoy performing music with a simple operation. Another aspect is to provide a sound generation device capable of being caused to sing a song with a simple operation. Still another aspect is to provide a sound generation program used in the above-described sound generation devices.

The exemplary embodiments have the following features to attain the aspects mentioned above (notes in parentheses indicate exemplary elements which can be found in the embodiments to follow, though such notes are not intended to limit the scope of the invention).

According to a first aspect, a sound generation device (composed of a main unit 10 and a game cartridge 30) outputs a sound in accordance with an operation by a performer, and comprises a housing, a tilt detecting unit, a sound waveform data storing unit, a sound waveform data reading unit, a sound waveform data processing unit, and a sound outputting unit. The housing (a game device housing 11) is capable of being held by both hands. The tilt detecting unit (comprising an XY-axes acceleration sensor 31, a sensor interface circuit 32, and a CPU 21 executing step S104 or step S206) detects an amount of tilt (around a Y-axis) in at least one direction of the housing. The sound waveform data storing unit (an area of a program ROM 33, in which human voice sound waveform data 51 is stored) stores at least one piece of sound waveform data (human voice sound waveform data 51). The sound waveform data reading unit (the CPU executing step S106 or step S209) reads the sound waveform data from the sound waveform data storing unit at a predetermined timing (for example, when an A button is pressed, or at timing stored in the program ROM 33). The sound waveform data processing unit (comprising a sound generation circuit 23, and the CPU 21 executing steps S105, S107, and S108, or steps S207, S210, and S211) changes at least a frequency of the sound waveform data read by the sound waveform data reading unit in accordance with the amount of tilt detected by the tilt detecting unit. The sound outputting unit (comprising the sound generation circuit 23, a loudspeaker 18, and the CPU 21 executing step S109 or step S212) outputs the sound waveform data processed by the sound waveform data processing unit as a sound. As such, in accordance with the amount of tilt of the device, a frequency of the sound waveform data is changed, whereby a pitch of the sound output from the sound generation device is changed. Thus, it is possible to provide a sound generation device allowing the performer to operate with enjoyment and perform music with ease by only tilting.

According to a second aspect the tilt detecting unit detects amounts of tilt (around an X-axis and around the Y-axis) in at least two directions of the housing. The sound waveform data processing unit changes a frequency of the sound waveform data read by the sound waveform data reading unit in accordance with an amount of tilt (around the Y-axis) in a first direction detected by the tilt detecting unit, and changes an amplitude of the sound waveform data in accordance with an amount of tilt (around the X-axis) in a second direction detected by the tilt detecting unit. As such, in accordance with the amount of tilt of the device, a frequency and an amplitude of the sound waveform data are changed, whereby a pitch and a volume of the sound output from the sound generation device are changed. Thus, it is possible to provide a sound generation device allowing the performer to operate with enjoyment and perform music with ease by only tilting.

According to a third aspect, the sound generation device further comprises a lyrics data storing unit. The lyrics data storing unit (an area of the program ROM 33, in which lyrics data 53 is stored) stores at least one piece of lyrics data (lyrics data 53). Also, the sound waveform data storing unit at least stores, as sound waveform data, human voice sound waveform data (human voice sound waveform data 51) obtained when a person utters, at a predetermined pitch, syllables included in the lyrics data stored in the lyrics data storing unit. The sound waveform data reading unit sequentially reads syllables included in the lyrics data from the lyrics data storing unit, and reads human voice sound waveform data corresponding to the read syllable from the sound waveform data storing unit. As such, the sound waveform data, which corresponds to each syllable in the lyrics and whose frequency is changed in accordance with the amount of tilt of the device, is sequentially output at a predetermined timing. Thus, it is possible to provide a sound generation device capable of being caused to sing a song by only tilting.

According to a fourth aspect, the sound generation device further comprises a first operation unit. The first operation unit (the A button 16) is used by the performer for specifying a sound outputting timing. Also, when the first operation unit is operated (the A button 16 is pressed), the sound waveform data reading unit reads the sound waveform data from the sound waveform data storing unit. As such, the sound waveform data whose frequency is changed in accordance with the amount of tilt of the device is output at the timing specified by the performer. Thus, it is possible to provide a sound generation device allowing the performer to operate while specifying a rhythm or a tempo of a performance.

According to a fifth aspect, the sound generation device further comprises a backing music data storing unit and a second operation unit. The backing music data storing unit (an area of the program ROM 33, in which backing music data 54 is stored) stores at least one piece of backing music data (backing music data 54). The second operation unit (a start button 14) is used by the performer for specifying a backing music start timing. Also, after the second operation unit is operated (the start button 14 is pressed), the sound outputting unit sequentially reads the backing music data from the backing music data storing unit, and outputs the read backing music data along with the sound waveform data processed by the sound waveform data processing unit. As such, a backing music is output from the sound generation device along with a sound. Thus, it is possible to notify the performer of an operation timing of the device, thereby enhancing the usability of the sound generation device.

According to a sixth aspect the sound generation device further comprises a reference play data storing unit, a musical performance results storing unit, a musical performance results checking unit, and a musical performance final results notification unit. The reference play data storing unit (an area of the program ROM 33, in which reference play data 55 is stored) stores at least one piece of reference play data (reference play data 55). The musical performance results storing unit (a work RAM 27 and the CPU 21 executing step S208) stores the amount of tilt detected by the tilt detecting unit as musical performance results data (musical performance results data to be stored in the work RAM 27), by associating the detected amount of tilt with the backing music data stored in the backing music data storing unit. The musical performance results checking unit (the CPU executing step S217) checks the musical performance results data stored in the musical performance results storing unit against the reference play data stored in the reference play data storing unit. The musical performance final results notification unit (comprising an LCD panel 12, the loudspeaker 18, and the CPU executing step S218) notifies the performer of checking results obtained by the musical performance results checking unit as performance final results. As such, the amount of tilt of the device during a performance is checked against a model after the performance is over. The above-described checking results indicate how correctly the performer has performed the song at a right pitch. Thus, it is possible to realize a sound generation device having an enhanced function as a game device by notifying the performer of the checking results.

According to a seventh aspect, the sound generation device further comprises a first operation unit. The first operation unit (the A button 16) is used by the performer for specifying a sound outputting timing. Also, when the first operation unit is operated (the A button 16 is pressed), the sound waveform data reading unit reads the sound waveform data from the sound waveform data storing unit. The musical performance results storing unit stores an operation timing of the first operation unit as a portion of the musical performance results data, by associating the operation timing with the backing music data stored in the backing music data storing unit. As such, an operation timing during a performance is checked against a model after the performance is over. The above-described checking results indicate how correctly the performer has performed the song at a right pitch, with a right rhythm, and in a right tempo. Thus, it is possible to realize a sound generation device having an enhanced function as a game device by notifying the performer of the checking results.

According to an eighth aspect, a sound generation program causes a game machine to function as a sound generation device. The game machine (composed of the main unit 10 and the game cartridge 30) includes a housing (the game device housing 11) capable of being held by both hands, a tilt detecting unit (comprising the XY-axes acceleration sensor 31 and the sensor interface circuit 32) for outputting a value (X-axis acceleration) corresponding to an amount of tilt in at least one direction of the housing, a program storing unit (a program storage area 40) for storing a program, a data storing unit (a data storage area 50) for storing data including at least one piece of sound waveform data (human voice sound waveform data 51), a program processing unit (the CPU 21) for processing the data stored in the data storing unit, based on the program stored in the program storing unit, and a sound outputting unit (comprising the sound generation circuit 23 and the loudspeaker 18) for outputting processing results obtained by the program processing unit as a sound. The sound generation program comprises a tilt calculating step, a sound waveform data reading step, a sound waveform data processing step, and a sound output controlling step. The tilt calculating step (step S104 or step S206) obtains an amount of tilt (around the Y-axis) in at least one direction of the housing, based on the value (X-axis acceleration) output from the tilt detecting unit. The sound waveform data reading step (step S106 or step S209) reads the sound waveform data from the data storing unit at a predetermined timing (for example, when the A button 16 is pressed, or at timing stored in the program ROM 33). The sound waveform data processing step (steps S105, S107, and S108, or steps S207, S210, and S211) changes at least a frequency of the sound waveform data read at the sound waveform data reading step, in accordance with the amount of tilt (around the Y-axis) obtained at the tilt calculating step. The sound output controlling step (step S109 or step S212) causes the sound waveform data processed at the sound waveform data processing step to be output from the sound outputting unit as a sound.

According to a ninth aspect, the tilt detecting unit outputs values (acceleration in X-and Y-axes directions) corresponding to amounts of tilt in at least two directions of the housing. Also, the tilt calculating step obtains the amounts of tilt (around the X-axis and around the Y-axis) in at least two directions of the housing, based on the values output from the tilt detecting unit. The sound waveform data processing step changes a frequency of the sound waveform data read at the sound waveform data reading step, in accordance with an amount of tilt (around the Y-axis) in a first direction obtained at the tilt calculating step, and changes an amplitude of the sound waveform data in accordance with an amount of tilt (around the X-axis) in a second direction obtained at the tilt calculating step.

According to a tenth aspect, the data storing unit further stores at least one piece of lyrics data (lyrics data 53), and stores, as sound waveform data, at least human voice sound waveform data (human voice sound waveform data 51) obtained when a person utters syllables included in the stored lyrics data at a predetermined pitch. Also, the sound waveform data reading step sequentially reads syllables included in the lyrics data from the data storing unit, and reads human voice sound waveform data corresponding to the read syllable from the data storing unit.

According to an eleventh aspect, the game device further includes a first operation unit (the A button 16) with which the performer specifies a sound outputting timing. When the first operation unit is operated (the A button 16 is pressed), the sound waveform data reading step reads the sound waveform data from the data storing unit.

According to a twelfth aspect, the game device further includes a second operation unit (the start button 14) with which the performer specifies a backing music start timing. The data storing unit further stores at least one piece of backing music data (backing music data 54). After the second operation unit is operated (the start button 14 is pressed), the sound output controlling step sequentially reads the backing music data from the data storing unit, and outputs the read backing music data along with the sound waveform data processed at the sound waveform data processing step.

According to a thirteenth aspect, the data storing unit further stores at least one piece of reference play data (reference play data 55). Also, the sound generation program further comprises a musical performance results storing step, a musical performance results checking step, and a musical performance final results notification step. The musical performance results storing step (step S208) causes the data storing unit to store the amount of tilt obtained at the tilt calculating step as musical performance results, by associating the obtained amount of tilt with the backing music data stored in the data storing unit. The musical performance results checking step (step S217) checks the musical performance results data stored at the musical performance results storing step against the reference play data stored in the data storing unit. The musical performance final results notification step (step S218) notifies the performer of checking results obtained at the musical performance results checking step as performance final results.

According to a fourteenth aspect, the game device further includes a first operation unit (the A button 16) with which the performer specifies a sound outputting timing. When the first operation unit is operated (the A button is pressed), the sound waveform data reading step reads the sound waveform data from the data storing unit. The musical performance results storing step stores an operation timing of the first operation unit as a portion of the musical performance results data, by associating the operation timing with the backing music data stored in the data storing unit.

These and other objects, features, aspects and advantages of the exemplary embodiments of will become more apparent from the following detailed description of exemplary embodiments the present invention when taken in conjunction with the accompanying drawings.

DESCRIPTION OF NON-LIMITING EXEMPLARY EMBODIMENTS

Figure 1:
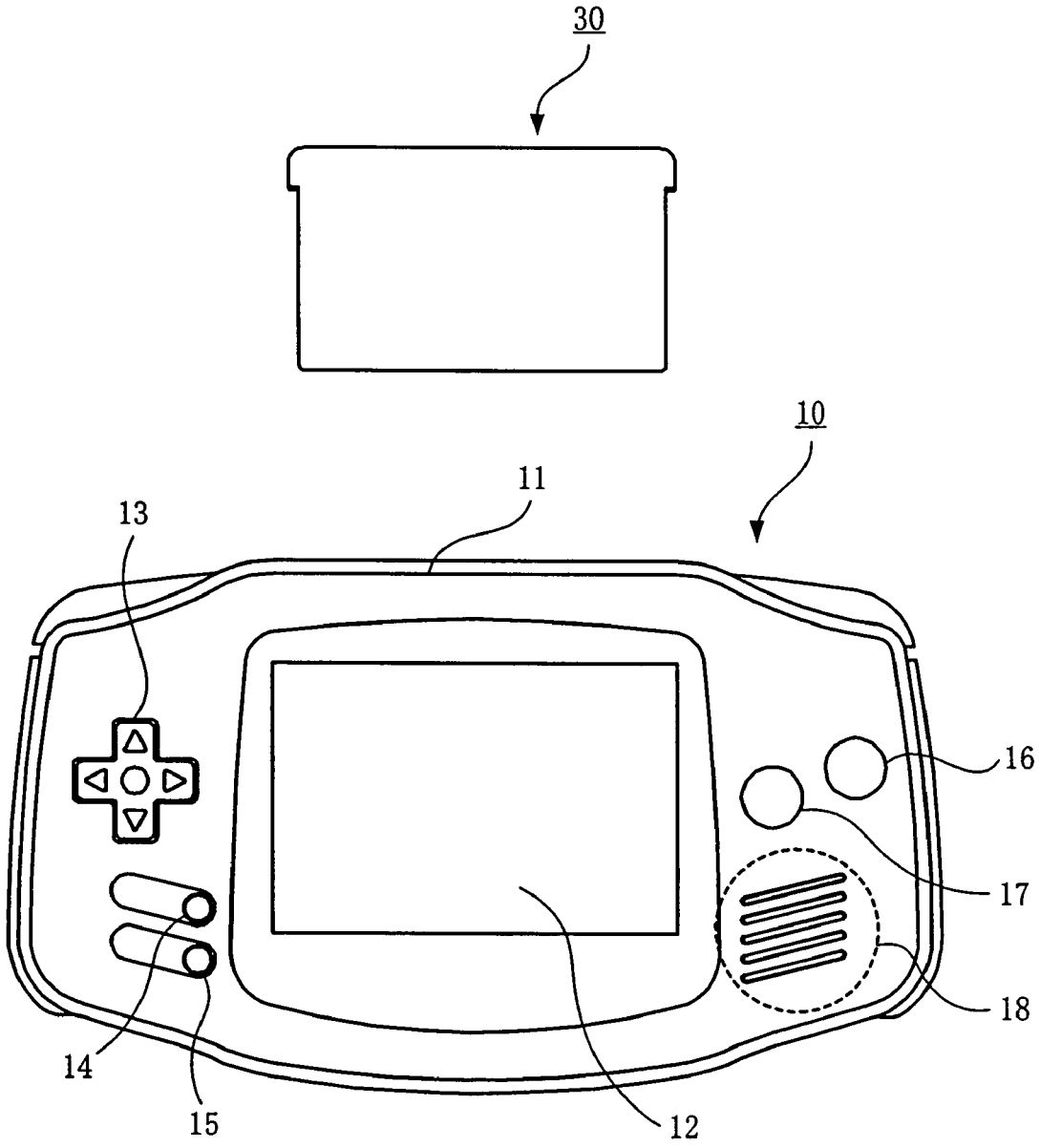
FIG. 1 is an illustration showing an external view of a sound generation device according to embodiments of the present invention.

FIG. 1 is an illustration showing an external view of a sound generation device according to embodiments of the present invention. The sound generation device includes a main unit 10 and a game cartridge 30 removably inserted into the main unit 10. When viewed from the front, the main unit 10 has a game device housing 11, an LCD panel 12, a cross button 13, a start button 14, a select button 15, an A button 16, a B button 17, and a loudspeaker 18. The game cartridge 30 stores a program (hereinafter, referred to as a sound generation program) for causing the main unit 10 to function as a sound generation device.

Figure 2:
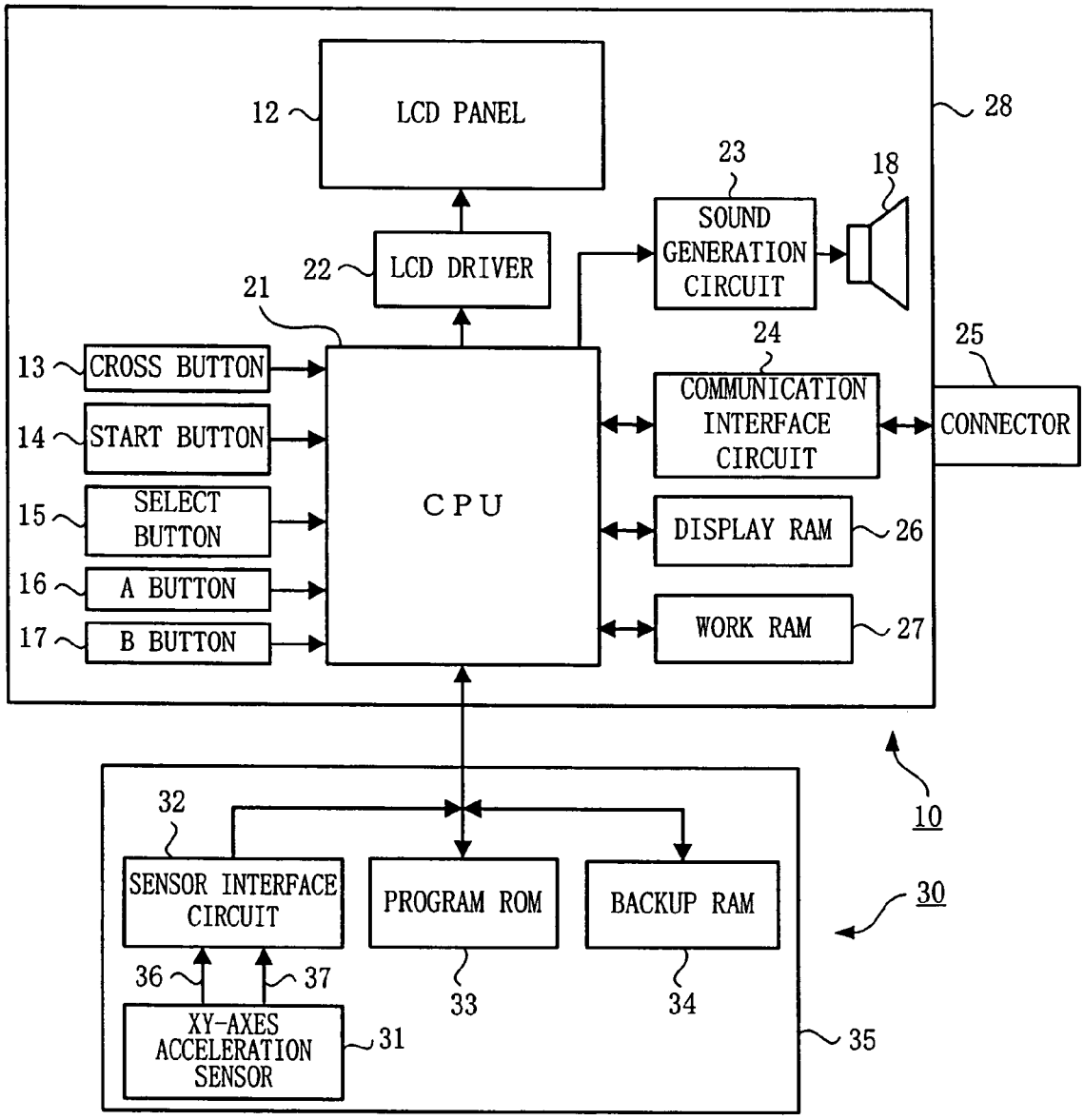
FIG. 2 is an illustration showing the hardware structure of the sound generation device according to the embodiments of the present invention.

FIG. 2 is an illustration showing the hardware structure of the sound generation device shown in FIG. 1. The main unit 10 includes a board 28, and the game cartridge 30 includes a board 35. The LCD panel 12, various buttons 13 to 17, the loudspeaker 18, a CPU 21, an LCD driver 22, a sound generation circuit 23, a communication interface circuit 24, a connector 25, a display RAM 26, and a work RAM 27 are mounted on the board 28. An XY-axes acceleration sensor 31, a sensor interface circuit 32, a program ROM 33, and a backup RAM 34 are mounted on the board 35.

The CPU 21 controls an operation of the main unit 10. The CPU 21 is connected to the various buttons 13 to 17, the LCD driver 22, the sound generation circuit 23, the communication interface circuit 24, the display RAM 26, the work RAM 27, the sensor interface circuit 32, the program ROM 33, and the backup RAM 34. The cross button 13, the start button 14, the select button 15, the A button 16, and the B button 17 are input devices operated by a player.

The LCD driver 22, which is connected to the LCD panel 12, drives the LCD panel 12 in accordance with control from the CPU 21. The sound generation circuit 23, which is connected to the loudspeaker 18, causes the loudspeaker 18 to output a sound in accordance with control from the CPU 21. The communication interface circuit 24 is connected to the connector 25. A communication cable (not shown) is connected to the connector 25, whereby the main unit 10 is communicably connected to another main unit (not shown). The display RAM 26 stores screen data to be displayed on the LCD panel 12. The work RAM 27 is a work memory used by the CPU 21.

The program ROM 33 stores the sound generation program and data to be used by the sound generation program. The backup RAM 34 stores data to be saved during the execution of the sound generation program. The CPU 21 executes the sound generation program stored in the program ROM 33 for performing various processes including: a process to receive an instruction from the player operating the various buttons 13 to 17, a process to control the LCD driver 22 and the display RAM 26 so as to cause the LCD panel 12 to display a screen, and a process to control the sound generation circuit 23 so as to cause the loudspeaker 18 to output a sound.

Figure 3:
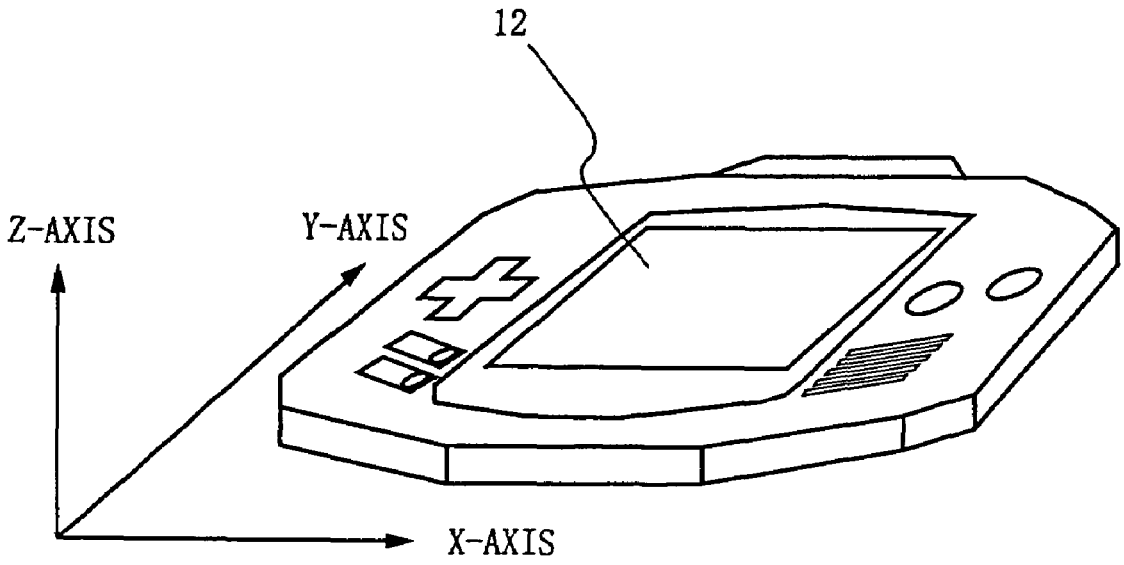
FIG. 3 is an illustration showing coordinate axes set for the sound generation device according to the embodiments of the present invention.

The XY-axes acceleration sensor 31 and the sensor interface circuit 32 are provided for obtaining a tilt of the main unit 10 (that is, a tilt of the game device housing 11) during a time period when the game cartridge 30 is inserted into the main unit 10. Hereinafter, a vertical coordinate system shown in FIG. 3 is set for the main unit 10. In the above-described coordinate system, it is assumed that a horizontal direction, a vertical direction, and a perpendicular direction relative to a display surface of the LCD panel 12 are an X-axis, a Y-axis, and a Z-axis, respectively.

The XY-axes acceleration sensor 31 detects acceleration in the respective directions of the X-and Y-axes of the main unit 10, and outputs a first detection signal 36 indicating X-axis acceleration and a second detection signal 37 indicating Y-axis acceleration. The sensor interface circuit 32 converts the two types of acceleration detected by the XY-axes acceleration sensor 31 into a form capable of being input into the CPU 21. For example, as the first detection signal 36, the XY-axes acceleration sensor 31 outputs a signal having one time period when its value is 0 and one time period when the value is 1 during a predetermined one cycle, wherein the length of the latter time period increases with an increase in the X-axis acceleration. The sensor interface circuit 32 generates pulses at an interval shorter than the cycle of the first detection signal 36, and counts the number of pulses generated during the time period when the value of the first detection signal 36 is 1, thereby obtaining the X-axis acceleration. The Y-axis acceleration is obtained in a manner similar to the X-axis acceleration.

Figure 4:
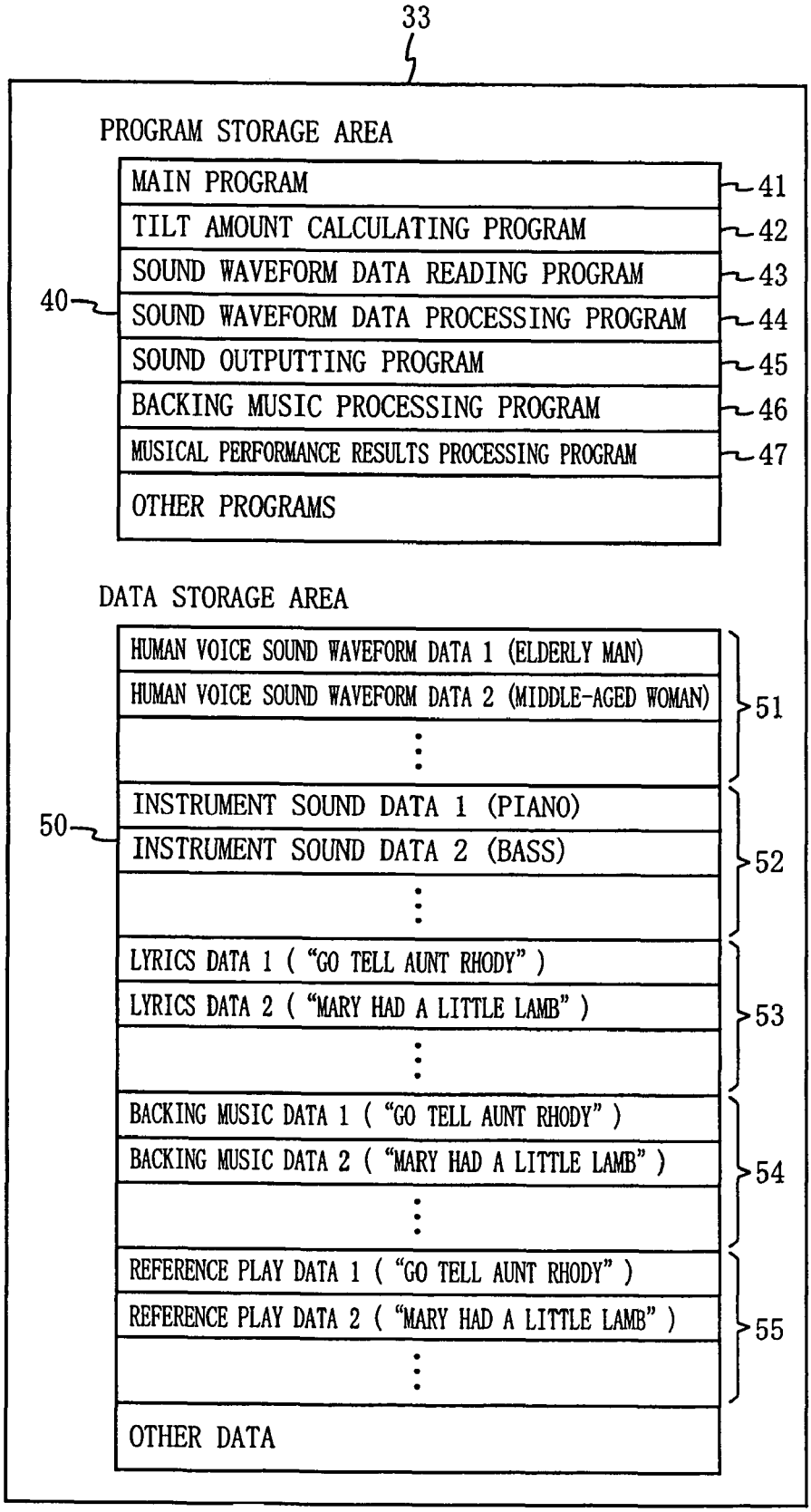
FIG. 4 is a memory map of a program ROM included in the sound generation device according to the embodiments of the present invention.

FIG. 4 is a memory map of the program ROM 33. The program ROM 33 includes a program storage area 40 for storing the sound generation program, and a data storage area 50 for storing data to be used by the sound generation program. As the sound generation program, the program storage area 40 stores, for example, a main program 41, a tilt amount calculating program 42, a sound waveform data reading program 43, a sound waveform data processing program 44, a sound outputting program 45, a backing music processing program 46, and a musical performance results processing program 47. Details of the sound generation program will be described below.

The data storage area 50 stores at least one piece of sound waveform data as data to be used by the sound generation program. More specifically, the data storage area 50 stores human voice sound waveform data 51 which is a typical example of the sound waveform data, instrument sound data 52, lyrics data 53, backing music data 54, reference play data 55, etc. The lyrics data 53 is lyrics data of a song to be sung by the sound generation device (that is, a song to be output from the sound generation device). The backing music data 54 is data to be referred to when a backing music process described below is performed. The lyrics data 53 and the backing music data 54 are not necessarily required to correspond with each other. For example, one piece of lyrics data may correspond to more than one piece of backing music data, or one piece of backing music data may correspond to more than one piece of lyrics data. The reference play data 55 will be described below.

The human voice sound waveform data 51 is waveform data of a human voice sound obtained when a person utters various syllables (for example, syllables included in words "go" and "Rhody") at a predetermined pitch. The human voice sound waveform data 51 at least includes waveform data about the syllables included in the lyrics data 53. Also, the human voice sound waveform data 51 may include waveform data of a plurality of human voice sounds having different characteristics. For example, the human voice sound waveform data 51 may include waveform data obtained when an elderly man utters various syllables, or waveform data obtained when a middle-aged woman utters various syllables (see FIG. 4).

The instrument sound data 52 is waveform data of a sound output from various instruments. The instrument sound data 52 includes waveform data obtained when the various instruments are played at a predetermined pitch. Also, the instrument sound data 52 may include waveform data of sounds output from different types of instruments. For example, the instrument sound data 52 may include waveform data obtained when a piano or a bass is played (see FIG. 4).

With reference to FIG. 5, an operation method of the sound generation device shown in FIG. 1 is described. FIG. 5A is an illustration of a basic position at the time of operation of the sound generation device, seen from directly above. In the basic position, the player (hereinafter, referred to as "performer") of the sound generation device holds the game device housing 11 horizontally with both hands as shown in FIG. 5A.

Figure 5A:
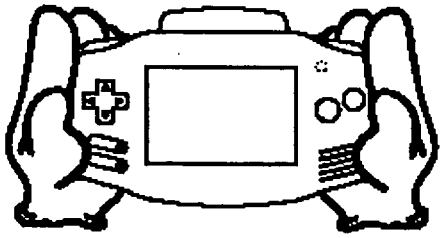
FIGS. 5A to 5D are illustrations showing an operation method of the sound generation device according to the embodiments of the present invention.
Figure 5B:
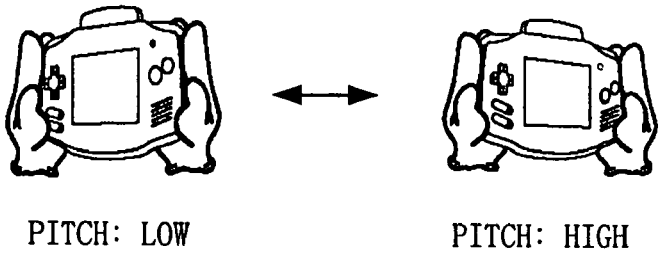

FIG. 5B is an illustration of an operation method for changing a pitch of a sound output from the sound generation device, seen from directly above. The sound generation device obtains the amount of tilt around the Y-axis of the main unit 10 based on the X-axis acceleration of the main unit 10, and outputs a sound while changing its pitch in accordance with the obtained amount of tilt. More specifically, the more heavily the performer tilts the left portion of the device around the Y-axis in a downward direction (an illustration on the left of FIG. 5B), the further the sound generation device lowers the pitch. On the other hand, the more heavily the performer tilts the right portion of the device around the Y-axis in a downward direction (an illustration on the right of FIG. 5B), the further the sound generation device increases the pitch. Thus, the performer can change the pitch of the sound output from the sound generation device by tilting the left or the right portion of the main unit 10 around the Y-axis from the basic position shown in FIG. 5A.

Figure 5C:
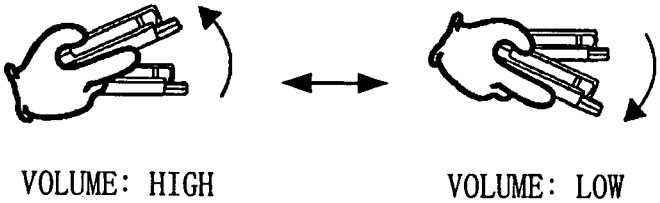

FIG. 5C is an illustration of an operation method for changing the volume of a sound output from the sound generation device, seen from the right side of the device. The sound generation device obtains the amount of tilt around the X-axis of the main unit 10 based on the Y-axis acceleration of the main unit 10, changes the volume in accordance with the obtained amount of tilt, and outputs the sound. More specifically, the more heavily the performer tilts the upper portion of the device around the X-axis in an upward direction (an illustration on the left of FIG. 5C), the further the sound generation device raises the volume. On the other hand, the more heavily the performer tilts the upper portion of the device around the X-axis in a downward direction around the X-axis (an illustration on the right of FIG. 5C), the further the sound generation device lowers the volume. Thus, the performer can change the volume of the sound output from the sound generation device by tilting the upper portion of the main unit 10 in an upward or downward direction from the basic position shown in FIG. 5A.

Figure 5D:
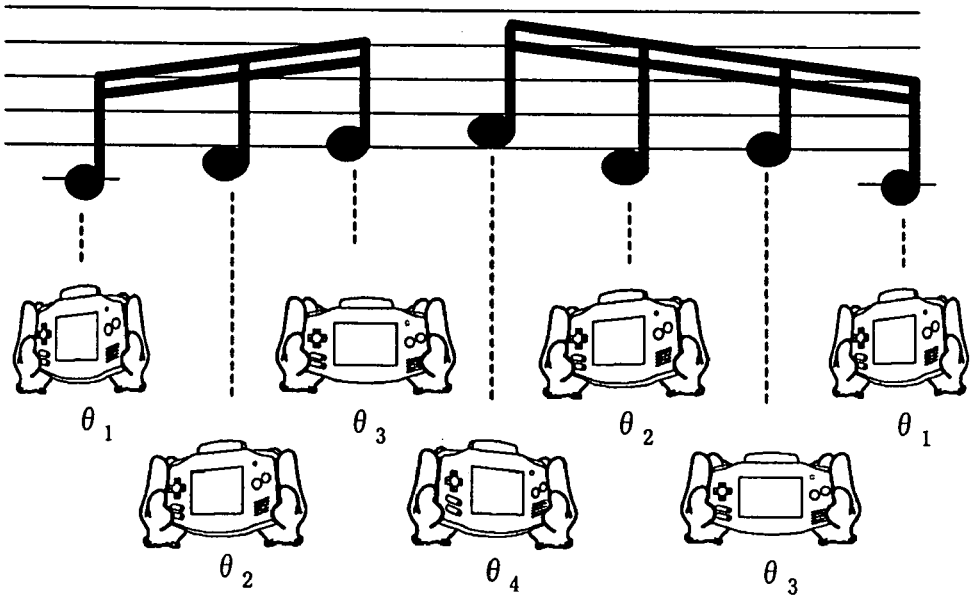

FIG. 5D is an illustration of an operation method for continuously changing the pitch of a sound output from the sound generation device. When the performer tilts the main unit 10 by a first angle of $\theta_1$ degrees around the Y-axis, the sound generation device output a first syllable at the pitch of "do". Then, when the performer tilts the main unit 10 by a second angle of $\theta_2$ degrees around the Y-axis, the sound generation device outputs a second syllable at the pitch of "re". Similarly, when the performer sequentially tilts the main unit 10 by angles of $\theta_3$, $\theta_4$, $\theta_2$, $\theta_3$, and $\theta_1$ degrees around the Y-axis, the sound generation device sequentially outputs syllables at the pitches of "mi", "fa", "re", "mi", and "do".

Note that the sound generation device detects the amount of tilt in the two directions of the main unit 10, but a pitch may be arbitrarily changed based on the amount of tilt in either of the two directions. However, in the case where a game device is shaped like a rectangular flat box, the pitch may be preferably changed based on the amount of tilt in a horizontal direction (that is, the amount of tilt around the Y-axis) of the display surface of the LCD panel 12, for reasons of necessity to change the pitch in multi-levels for performing a tune.

Also, a correspondence between the amount of tilt of the main unit and the pitch may be arbitrarily determined as long as the following condition, that is, the pitch becomes lower with an increase in the amount of tilt in one direction, and becomes higher with an increase in the amount of tilt in the opposite direction, is satisfied. For example, the sound generation device may change the pitch in either a phased or a continuous manner in accordance with the amount of tilt of the main unit. If the pitch is changed in a continuous manner, the sound generation device can output a sound at an intermediate pitch between a whole tone and a semitone. As a result, the performer can cause the sound generation device to sing a song with vibrato, which enhances the enjoyment of performing music by the sound generation device.

Figure 6:
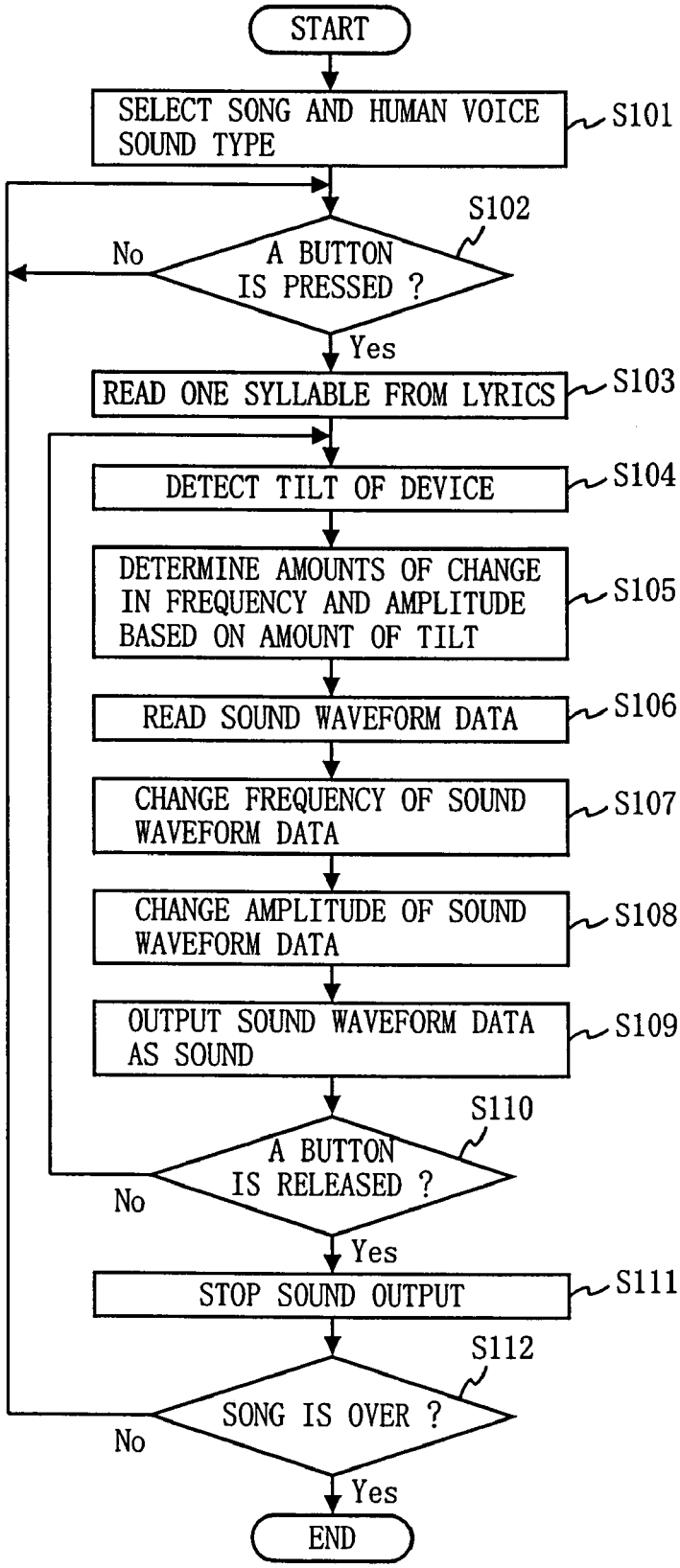
FIG. 6 is a flowchart showing an operation of the sound generation device according to a first embodiment of the present invention.

FIG. 6 is a flowchart showing an operation of the sound generation device according to a first embodiment of the present invention. FIG. 6 shows a process performed when the sound generation device sings a song. The CPU 21 executes the process shown in FIG. 6 by executing the sound generation program stored in the program storage area 40. The process shown in FIG. 6 is included in the main program 41, the tilt amount calculating program 42, the sound waveform data reading program 43, the sound waveform data processing program 44, and the sound outputting program 45 of the programs shown in FIG. 4. Also, the human voice sound waveform data 51 and the lyrics data 53 of the data shown in FIG. 4 are referred to in order to execute the process shown in FIG. 6.

First, the CPU 21 selects a song to be sung and a human voice sound type to be used in singing the selected song (step S101). For example, the CPU 21 reads possible songs and human voice sound types (human voice sounds of an elderly man and a middle-aged woman, for example) from the program ROM 33, causes the LCD panel 12 to display the read songs and human voice sound types, and selects a desired song and human voice sound type in accordance with an instruction from the performer. The CPU 21 repeats the process from step S102 to step S111 until the determination is made that the song is over at step S112.

At step S102, the CPU 21 determines whether or not the A button 16 is pressed by the performer. If the determination is made that the A button 16 is not pressed ("NO" at step S102), the CPU 21 does not proceed from step S102. On the other hand, if the determination is made that the A button 16 is pressed ("YES" at step S102), the CPU 21 proceeds to step S103. As such, the CPU 21 remains in a waiting state at step S102 until the A button 16 is pressed.

When the A button 16 is pressed, the CPU 21 reads one syllable in the lyrics from the lyrics data 53 (step S103). More specifically, the CPU 21, which has a pointer pointing to a syllable to be output next among the lyrics of the song selected at step S101, reads the syllable pointed at by the pointer at step S103, and advances the pointer to the next syllable. The syllable read at step S103 is continuously used until the process at step S103 is performed again.

Next, the CPU 21 detects a tilt of the main unit 10 (that is, a tilt of the game device housing 11) (step S104). As aforementioned, the sensor interface circuit 32 converts the two respective types of acceleration detected by the XY-axes acceleration sensor 31 into a form capable of being input into the CPU 21. Thus, based on the X axis acceleration output from the sensor interface circuit 32, the CPU 21 calculates the amount of tilt around the Y-axis of the main unit 10. Also, based on the Y-axis acceleration output from the sensor interface circuit 32, the CPU 21 calculates the amount of tilt around the X-axis of the main unit 10.

Next, based on the two amounts of tilt obtained at step S104, the CPU 21 determines the amounts of change in frequency and amplitude of the sound waveform data to be output (step S105). The CPU 21 determines the amount of change in frequency in accordance with the amount of tilt around the Y-axis of the main unit 10. More specifically, the more heavily the performer tilts the left portion of the main unit 10 around the Y-axis in a downward direction, the smaller the negative value the CPU 21 selects. On the other hand, the more heavily the performer tilts the right portion of the main unit 10 around the Y-axis in a downward direction, the greater the positive value the CPU 21 selects. Also, the CPU 21 determines the amount of change in amplitude in accordance with the amount of tilt around the X-axis of the main unit 10. More specifically, the more heavily the performer tilts the upper portion of the main unit 10 around the X-axis in an upward direction, the greater the positive value the CPU 21 selects. On the other hand, the more heavily the performer tilts the upper portion of the main unit 10 around the Y-axis in a downward direction, the smaller the negative value the CPU 21 selects.

Next, the CPU 21 reads a piece of data corresponding to one syllable from the human voice sound waveform data 51, as sound waveform data (step S106). More specifically, from the human voice sound waveform data 51, the CPU 21 selects data corresponding to the human voice sound type selected at step S101, and reads therefrom a piece of waveform data corresponding to the syllable read at step S103. For example, in the case where a human voice sound type of "an elderly man" is selected at step S101 and a syllable "go" is read at step S103, the CPU 21 reads the waveform data obtained when an elderly man utters "go".

Next, based on the amount of change in frequency obtained at step S105, the CPU 21 changes a frequency of the sound waveform data read at step S106 (step S107). Next, based on the amount of change in amplitude obtained at step S106, the CPU 21 changes an amplitude of the sound waveform data processed at step S107 (step S108). Note that, when performing processes at steps S107 and S108, the CPU 21 may cause the sound generation circuit 23 to perform a portion or all of the above-described processes.

Next, the CPU 21 controls the sound generation circuit 23, and causes the sound generation circuit 23 to output the sound waveform data processed at steps S107 and S108 from the loudspeaker 18 as a sound (step S109). Thus, the one syllable in the lyrics read at step S103 is output from the sound generation device at a pitch corresponding to the amount of tilt around the Y-axis of the main unit 10 at a volume corresponding to the amount of tilt around the X-axis of the main unit 10.

Next, the CPU 21 determines whether or not the A button 16 is released by the performer (step S110). If the determination is made that the A button 16 is not released ("NO" at step S110), the CPU 21 goes back to step S104. In this case, the CPU 21 performs the process from step S104 to step S109 again for the one syllable read at step S103. As a result, the same one syllable in the lyrics is repeatedly output from the sound generation device, varying its pitch and volume, until the A button 16 is released.

If the determination is made that the A button 16 is released ("YES" at step S110), the CPU 21 proceeds to step S111. In this case, the CPU 21 controls the sound generation circuit 23, and causes the sound generation circuit 23 to stop output of the sound waveform data processed at steps S107 and S108 (step S111).

Next, the CPU 21 determines whether or not the selected song is over (step S112). If the determination is made that the song is not over ("NO" at step S112), the CPU 21 goes back to step S102. In this case, the CPU 21 performs the process from step S102 to step S111 again, and outputs the next syllable in the lyrics, varying its pitch and volume. If the determination is made that the song is over ("YES" at step S112), the CPU 21 ends the process performed for singing a song.

Figure 7A:
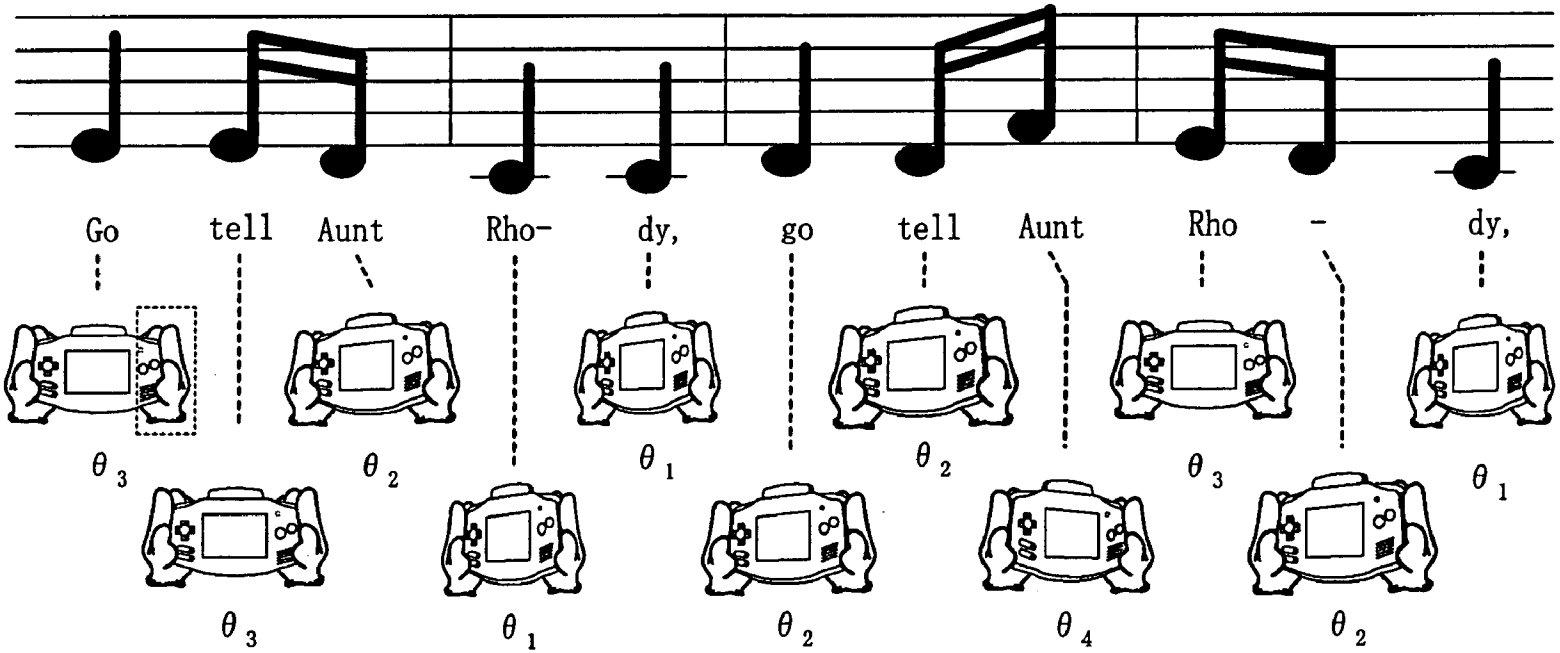
FIGS. 7A and 7B are illustrations showing an exemplary operation for causing the sound generation device of the embodiments of the present invention to sing a song.
Figure 7B:
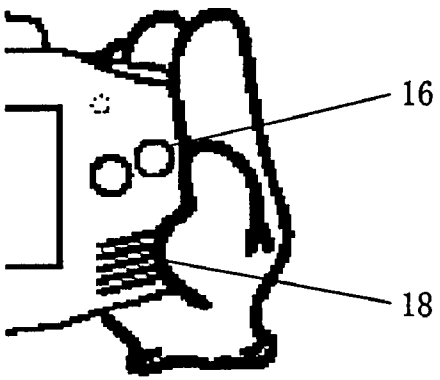

FIGS. 7A and 7B are illustrations showing an exemplary operation for causing the sound generation device to sing a song. As described above, the sound generation device outputs one syllable in the lyrics, varying its pitch and volume, from the loudspeaker 18 during a time period when the A button 16 is pressed. Thus, the performer can cause the sound generation device to sing a song by operating the sound generation device as shown in FIG. 7A. Note that FIG. 7B is an enlarged view of a rectangular portion enclosed with dashed line in FIG. 7A.

Before starting a performance, the performer selects a song (in this example, "Go Tell Aunt Rhody") to be sung by the sound generation device. Next, the performer tilts the main unit 10 by an angle of $\theta_3$ degrees, which corresponds to a pitch of "mi", around the Y-axis, and presses the A button 16 for a time period corresponding to a quarter note. As a result, a first syllable "go" is output from the sound generation device at a pitch of "mi" for only a time period corresponding to the quarter note. Next, the performer presses the A button 16 for a time period corresponding to an eighth note, tilting the main unit 10 by the angle of $\theta_3$ degrees around the Y-axis. As a result, a second syllable "tell" is output from the sound generation device at a pitch of "mi" for only a time period corresponding to the eighth note. Next, the performer tilts the main unit 10 by an angle of $\theta_2$ degrees, which corresponds to a pitch of "re", around the Y-axis, and presses the A button 16 for a time period corresponding to another eighth note. As a result, a third syllable "aunt" is output from the sound generation device at a pitch of "re" for only a time period corresponding to the eighth note. Hereinafter, the performer repeats the above-described operation in similar manners, that is, pressing the A button 16 for a predetermined time period while tilting the main unit 10 by an angle of predetermined degrees around the Y-axis, for each one syllable in the lyrics. The above-described operation allows the performer to cause the sound generation device to sing a song.

As described above, according to the sound generation device of the first embodiment, a frequency and an amplitude of sound waveform data are changed in accordance with a change in the amount of tilt of the device, whereby a pitch and a volume of a sound to be output from the sound generation device are changed accordingly. Thus, it is possible to provide a sound generation device allowing the performer to operate with enjoyment and perform music with ease by only tilting. Also, sound waveform data corresponding to syllables in the lyrics, whose frequencies are changed in accordance with the amount of tilt of a device, is sequentially output at a predetermined timing. Thus, it is possible to provide a sound generation device capable of being caused to sing a song by only tilting. Furthermore, sound waveform data whose frequencies are changed in accordance with the amount of tilt of a device is output at a timing specified by the performer. Thus, it is possible to provide a sound generation device allowing the performer to operate while specifying a rhythm or a tempo of a performance.

Figure 8:
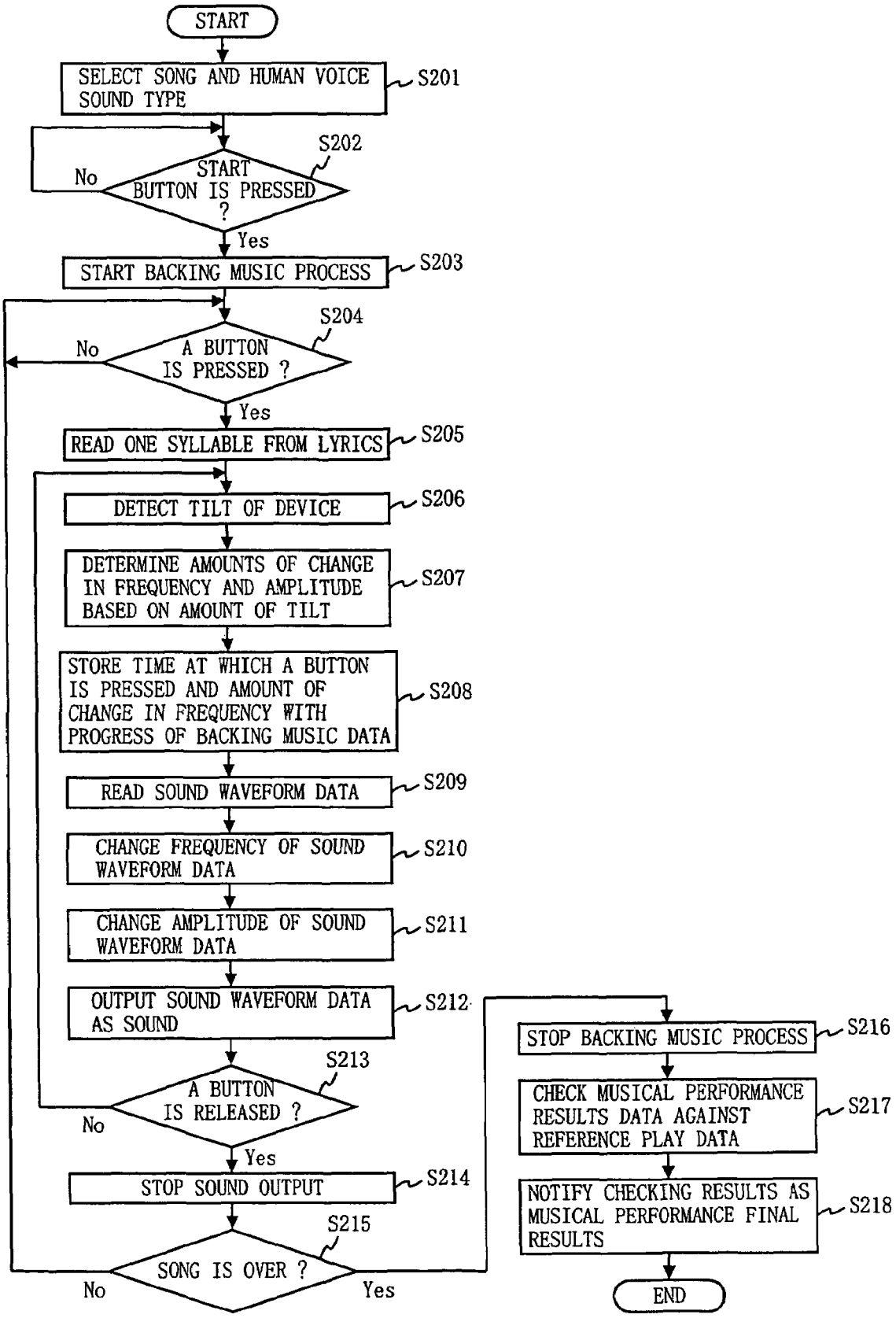
FIG. 8 is a flowchart showing an operation of a sound generation device according to a second embodiment of the present invention.

FIG. 8 is a flowchart showing an operation of a sound generation device according to a second embodiment of the present invention. The flowchart shown in FIG. 8 differs from the flowchart shown in FIG. 6 in that a process of performing a backing music, a process of storing musical performance results, a process of checking the musical performance results, and a process of notifying musical performance final results are additionally included. The process shown in FIG. 8 is included in the main program 41, the tilt amount calculating program 42, the sound waveform data reading program 43, the sound waveform data processing program 44, the sound outputting program 45, the backing music processing program 46, and the musical performance results processing program 47 of the programs shown in FIG. 4. Also, in order to execute the process shown in FIG. 8, the human voice sound waveform data 51, the instrument sound data 52, the lyrics data 53, the backing music data 54, and the reference play data 55 are referred to.

First, the CPU 21 selects a song to be sung and a human voice sound type to be used in singing the selected song, as is the case with the first embodiment (step S201). Then, the CPU 21 determines whether or not the start button 14 is pressed by the performer (step S202). If the determination is made that the start button 14 is not pressed ("NO" at step S202), the CPU 21 does not proceed from step S202. On the other hand, if the determination is made that the start button 14 is pressed ("YES" at step S202), the CPU 21 proceeds to step S203. As such, the CPU 21 remains in a waiting state at step S202 until the start button 14 is pressed.

When the start button 14 is pressed, the CPU 21 starts a backing music process for the song selected at step S201 (step S203). Here, the backing music process is a process of generating waveform data of a backing music of the song selected at step S201, based on the instrument sound data 52 and the backing music data 54, and outputting the generated waveform data from the loudspeaker 18 along with sound waveform data. The backing music process is continuously performed until the CPU 21 reaches step S216. The above-described backing music process allows the performer to know when to operate the sound generation device, thereby enhancing the usability of the sound generation device.

After starting the backing music, the CPU 21 repeats a process of outputting one syllable in the lyrics while changing its pitch and volume, as is the case with the first embodiment (steps S205 to S214). In the second embodiment, however, the CPU 21 obtains the amounts of change in frequency and amplitude at step S207, and causes the work RAM 27 to store a time at which the A button 16 is pressed and the obtained amount of change in frequency with the progress of the backing music data 54 (step S208).

When the selected song is over ("YES" at step S215), the CPU 21 proceeds to step S216. In this case, the CPU 21 stops the backing music process started at step S203 (step S216). At this point, times at which the A button 16 is pressed during a time period in which the selected song is performed and the amounts of change in frequency during the same time period are stored in the work RAM 27 as musical performance results data.

The reference play data 55 stored in the program ROM 33 is model data for the musical performance results data obtained when the musical performance is over. That is, the reference play data 55 includes correct times at which the A button should be pressed and correct values of the amounts of change in frequency.

The CPU 21 checks the musical performance results data stored in the work RAM 27 against the reference play data 55, which is the model data for the above-described musical performance results data (step S217). Note that the reference play data 55 used for the above-described checking is reference play data for the song selected at step S201. The CPU 21 compares the musical performance results data and the reference play data with respect to times at which the A button 16 is pressed and the amounts of change in frequency, and obtains musical performance final results data indicating the comparison results quantitatively. The higher the degree of agreement between the musical performance results data and the reference play data is, the better the musical performance final results are.

Next, the CPU 21 notifies the performer of the musical performance final results obtained at step S217 (step S218). For example, the CPU 21 may output the musical performance final results from the loudspeaker 18 as a sound, or cause the LCD panel 12 to display the musical performance final results. After notifying the performer of the musical performance final results, the CPU 21 ends the process of singing a song.

As described above, according to the sound generation device of the second embodiment, a backing music is output along with a sound. Thus, it is possible to notify the performer of an operation timing of the device, thereby enhancing the usability of the sound generation device. Also, the amount of tilt of the device and operation timing during a musical performance are checked against those of a model musical performance after the musical performance is over. The checking results obtained as described above indicate how correctly the performer has performed the song at a right pitch, with a right rhythm, and in a right tempo. Thus, it is possible to realize a sound generation device having an enhanced function as a game device by notifying the performer of the checking results.

Note that it is assumed that the sound generation devices according to the first and second embodiments output one syllable in the lyrics when the A button is pressed. In place of outputting one syllable in the lyrics when the A button is pressed, the sound generation device may sequentially output syllables in the lyrics at a predetermined timing stored in the program ROM. In this case, the performer tilts the sound generation device in predetermined two directions without pressing the A button, thereby causing the sound generation device to output a sound, varying its pitch and volume, and sing a song.

Also, it is assumed that waveform data of a human voice sound obtained when a person utters various syllables at a predetermined pitch is used as sound waveform data. In place of using the above-described waveform data of a human voice sound, or along with the above-described waveform data of a human voice sound, waveform data of an arbitrary sound (for example, waveform data of animal or machine sound) may be used. Furthermore, the number of sound types may be one (for example, a beep sound).

Also, it is assumed that the sound generation device is composed of the main unit and the game cartridge storing the sound generation program. However, the sound generation program and the tilt sensor may be previously built in the main unit.

While the exemplary embodiments been described in detail, the foregoing description is in all aspects illustrative and not restrictive. It is understood that numerous other modifications and variations can be devised without departing from the scope of the invention.

What is claimed is:

1. A sound generation device for outputting a sound in accordance with an operation by a performer, the device comprising:

a housing capable of being held by the performer;

a tilt detector for detecting an amount of tilt in at least one direction of the housing;

a sound waveform data storing area for storing at least one piece of sound waveform data;

a sound waveform data reader for reading the sound waveform data from the sound waveform data storing area at a predetermined timing;

a sound waveform data processor for changing at least a frequency of the sound waveform data read by the sound waveform data reader in accordance with the amount of tilt detected by the tilt detector; and a sound outputting unit for outputting the sound waveform data processed by the sound waveform data processor as a sound;

a backing music data storing area for storing at least one piece of backing music data, the sound outputting unit sequentially reading the backing music data from the backing music data storing area, and outputting the read backing music data along with the sound waveform data processed by the sound waveform data processor;

a reference play data storing area for storing at least one piece of reference play data;

a musical performance results storing area for storing the amount of tilt detected by the tilt detector as musical performance results data, by associating the detected amount of tilt with the backing music data stored in the backing music data storing area;

a musical performance results comparator for comparing the musical performance results data stored in the musical performance results storing area against the reference play data stored in the reference play data storing area; and musical performance final results notification unit for notifying the performer of results obtained by the musical performance results comparator as performance final results.

2. The sound generation device according to claim 1, wherein the tilt detector detects amounts of tilt in at least two directions of the housing, and the sound waveform data processor changes a frequency of the sound waveform data read by the sound waveform data reader in accordance with an amount of tilt in a first direction detected by the tilt detector, and changes an amplitude of the sound waveform data in accordance with an amount of tilt in a second direction detected by the tilt detector.

3. The sound generation device according to claim 1, further comprising lyrics data storing area for storing at least one piece of lyrics data, wherein the sound waveform data storing area at least stores, as sound waveform data, human voice sound waveform data obtained when a person utters, at a predetermined pitch, syllables included in the lyrics data stored in the lyrics data storing area, and the sound waveform data reader sequentially reads syllables included in the lyrics data from the lyrics data storing area, and reads human voice sound waveform data corresponding to the read syllable from the sound waveform data storing area.

4. The sound generation device according to claim 1, further comprising a first operation unit with which the performer specifies a sound outputting timing, wherein when the first operation unit is operated, the sound waveform data reader reads the sound waveform data from the sound waveform data storing area.

5. The sound generation device according to claim 1, further comprising a first operation unit with which the performer specifies a sound outputting timing, wherein when the first operation unit is operated, the sound waveform data reader reads the sound waveform data from the sound waveform data storing area, and the musical performance results storing area stores an operation timing of the first operation unit as a portion of the musical performance results data, by associating the operation timing with the backing music data stored in the backing music data storing area.

6. The sound generation device as in claim 1, further comprising an operation unit with which the performer specifies a backing music start timing, wherein the sound output unit sequentially reads the backing music data and outputs the backing music data after the operation unit is operated by the performer.

7. The sound generation device as in claim 1, wherein the tilt detector is arranged within a removable medium connected to the housing.

8. The sound generation device as in claim 1 wherein the notification unit comprises a display arranged on a surface of said housing.

9. A sound generation program stored on a machine-readable medium for causing a game machine to function as a sound generation device, wherein the game machine includes a housing capable of being held by a performer, a tilt detector for outputting a value corresponding to an amount of tilt in at least one direction of the housing, a program storing area for storing a program, a data storing area for storing data including at least one piece of sound waveform data, a program processor for processing the data stored in the data storing area, based on the program stored in the program storing area, and a sound outputting unit for outputting processing results obtained by the program processor as a sound, the sound generation program comprising:

a tilt calculating step of obtaining an amount of tilt in at least one direction of the housing, based on the value output from the tilt detector;

a sound waveform data reading step of reading the sound waveform data from the data storing area at a predetermined timing;

a sound waveform data processing step of changing at least a frequency of the sound waveform data read at the sound waveform data reading step, in accordance with the amount of tilt obtained at the tilt calculating step;

a sound output controlling step of causing the sound waveform data processed at the sound waveform data processing step to be output from the sound outputting unit as a sound;

wherein the data storing area further stores at least one piece of backing music data, and the sound output controlling step sequentially reads the backing music data from the data storing area, and outputs the read backing music data along with the sound waveform data processed at the sound waveform data processing step;

the data storing area further stores at least one piece of reference play data, and the sound generation program further comprises:

a musical performance results storing step of causing the data storing area to store the amount of tilt obtained at the tilt calculating step as musical performance results data, by associating the obtained amount of tilt with the backing music data stored in the data storing area;

a musical performance results comparing step of comparing the musical performance results data stored at the musical performance results storing step against the reference play data stored in the data storing area; and a musical performance final results notification step of notifying the performer of comparing results obtained at the musical performance results comparing step as performance final results.

10. The sound generation program according to claim 9, wherein the tilt detector outputs values corresponding to amounts of tilt in at least two directions of the housing, the tilt calculating step obtains the amounts of tilt in at least two directions of the housing, based on the values output from the tilt detector, and the sound waveform data processing step changes a frequency of the sound waveform data read at the sound waveform data reading step, in accordance with an amount of tilt in a first direction obtained at the tilt calculating step, and changes an amplitude of the sound waveform data in accordance with an amount of tilt in a second direction obtained at the tilt calculating step.

11. The sound generation program according to claim 9, wherein the data storing area further stores at least one piece of lyrics data, and stores, as sound waveform data, at least human voice sound waveform data obtained when a person utters syllables included in the stored lyrics data at a predetermined pitch, and the sound waveform data reading step sequentially reads syllables included in the lyrics data from the data storing area, and reads human voice sound waveform data corresponding to the read syllable from the data storing area.

12. The sound generation program according to claim 9, wherein the game device further includes first operation unit with which the performer specifies a sound outputting timing, and when the first operation unit is operated, the sound waveform data reading step reads the sound waveform data from the data storing area.

13. The sound generation program according to claim 9 wherein the game device further includes a first operation unit with which the performer specifies a sound outputting timing, when the first operation unit is operated, the sound waveform data reading step reads the sound waveform data from the data storing area, and the musical performance results storing step stores an operation timing of the first operation unit as a portion of the musical performance results data, by associating the operation timing with the backing music data stored in the data storing area.

14. The sound generation program as in claim 9, wherein the game machine further comprises an operational unit with which the performer specifies a backing music start timing, and the sound output controlling step sequentially reads the backing music data and outputs the read backing music after the second operation unit is operated.

15. The sound generation program as in claim 9, wherein the tilt detector is arranged within a removable medium connected to the housing.

16. The sound generation program as in claim 9 wherein the notification step comprises notifying the performer using a display arranged on a surface of said housing.

17. A medium which is removably inserted into a game machine including a housing capable of being held by a game machine user, a data storing area for storing data including at least one piece of sound waveform data, a program processor for processing the data stored in the data storing area based on a sound generation program, and a sound outputting unit for outputting processing results obtained by the program processor as a sound, the medium comprising:

a tilt detector for outputting a value corresponding to an amount of tilt in at least one direction of the housing; and a program storing area for storing the sound generation program executable by the game machine to cause the program processor to execute:

a tilt calculating step of obtaining an amount of tilt in at least one direction of the housing, based on the value output from the tilt detector of the medium;

a sound waveform data reading step of reading the sound waveform data from the data storing area at a predetermined timing;

a sound waveform data processing step of changing at least a frequency of the sound waveform data read at the sound waveform data reading step, in accordance with the amount of tilt obtained at the tilt calculating step; and a sound output controlling step of causing the sound waveform data processed at the sound waveform data processing step to be output from the sound outputting unit as a sound.

18. In a portable game apparatus including a housing to be handled by a user, a display arranged on one surface of the housing, a tilt detector associated with the housing for detecting an amount of tilt of the housing, a storage area for storing data, and a processor, a method of providing information to the user regarding the user's tilting of the housing comprising:

storing reference play data in the storage area;

receiving an output from the tilt detector indicating the detected amount of tilt of the housing by the user;

changing a frequency of sound waveform data in response to the output from the tilt detector;

generating user performance result data in response to the output from the tilt detector;

comparing the reference play data and the user performance data; and displaying information on the display regarding the user's tilting of the housing based on the comparing;

wherein the tilt detector is arranged in a removable medium which stores a game program to be executed by the processor and which is connected to the housing.

19. In a portable game apparatus including a housing to be handled by a user, a display arranged on one surface of the housing, a tilt detector associated with the housing for detecting an amount of tilt of the housing, a storage area for storing data, and a processor, a method of providing information to the user regarding the user's tilting of the housing comprising:

storing reference play data in the storage area;

receiving an output from the tilt detector indicating the detected amount of tilt of the housing by the user;

changing a frequency of sound waveform data in response to the output from the tilt detector;

generating user performance result data in response to the output from the tilt detector;

comparing the reference play data and the user performance data; and displaying information on the display regarding the user's tilting of the housing based on the comparing;

wherein the sound waveform data includes lyrics data of a known song and the frequency of at least one syllable in the lyrics of the song is changed based on the received output from the tilt detector.

20. The sound generating device of claim 1, wherein the frequency of the sound waveform data is changed in a continuous manner.

21. The sound generating device of claim 1, wherein an amplitude of the sound waveform data is changed in response to the output of the tilt detector.

* * * * *